US006575827B1

(12) United States Patent
Rutler et al.

(10) Patent No.: US 6,575,827 B1
(45) Date of Patent: Jun. 10, 2003

(54) TEMPORARY VENT OPENING COVER

(75) Inventors: Jay B. Rutler, Olathe, KS (US); Spencer B. Hawerlander, Olathe, KS (US); Tony Robert Plunkett, Olathe, KS (US)

(73) Assignee: Rutland, Inc., Olathe, KS (US)

( * ) Notice: Subject to any disclaimer, the term of this patent is extended or adjusted under 35 U.S.C. 154(b) by 0 days.

(21) Appl. No.: 10/114,186

(22) Filed: Apr. 2, 2002

Related U.S. Application Data

(63) Continuation-in-part of application No. 09/737,086, filed on Dec. 14, 2000, now Pat. No. 6,461,235.

(51) Int. Cl.[7] ..... F24F 13/28
(52) U.S. Cl. ..... 454/289; 55/385.2; 454/370
(58) Field of Search ..... 454/289, 370; 55/385.2

(56) References Cited

U.S. PATENT DOCUMENTS

| | | | |
|---|---|---|---|
| 674,991 | A | 5/1901 | Williams |
| 1,429,811 | A | 9/1922 | Tynan |
| 1,488,694 | A | 4/1924 | Marks |
| 1,911,851 | A | 5/1933 | Scholtz |
| 2,080,726 | A | 5/1937 | Lowinger |
| 2,743,660 | A | 5/1956 | Scherff |
| 3,232,205 | A | 2/1966 | Bumstead |
| 3,589,265 | A | 6/1971 | Hedrick |
| 4,502,368 | A | 3/1985 | Hempel |
| 4,712,343 | A | 12/1987 | Dearing et al. |
| 4,773,308 | A | 9/1988 | Allen, Jr. |
| 4,829,886 | A | 5/1989 | Battaglin |
| 5,100,445 | A | 3/1992 | Johnson et al. |
| 5,180,331 | A | 1/1993 | Daw et al. |
| 5,266,091 | A | 11/1993 | McDonald |
| 5,597,392 | A | 1/1997 | Hawkins et al. |
| 5,720,660 | A | 2/1998 | Benedetto et al. |
| 5,947,815 | A | 9/1999 | Danforth |
| 6,066,044 | A | 5/2000 | Orendorff |

*Primary Examiner*—Harold Joyce
(74) *Attorney, Agent, or Firm*—Shughart, Thomson & Kilroy, P.C.

(57) ABSTRACT

A temporary vent opening cover is disclosed which is securable over a vent opening in a floor or other surface during building construction to prevent debris from entering the vent opening and accumulating in duct work associated therewith. The cover includes a generally flat cover plate which is sized and shaped to cover the vent opening. The cover plate is spaced outwardly from the surface when the vent opening cover is secured over the vent opening. A plurality of air passages allow air to flow past the cover plate between the duct work and the workspace. A layer of air filter material covers the air passages and prevents debris from passing therethrough. A portion of cover plate may be dedicated to the display of promotional indicia.

17 Claims, 4 Drawing Sheets

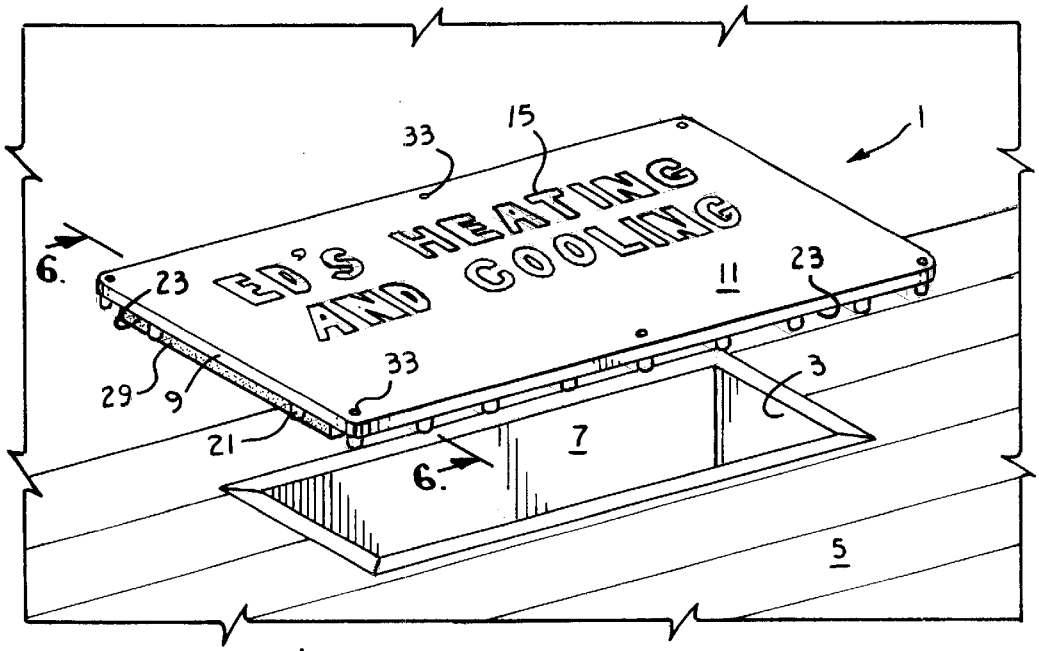
Fig.1.
Fig.2.
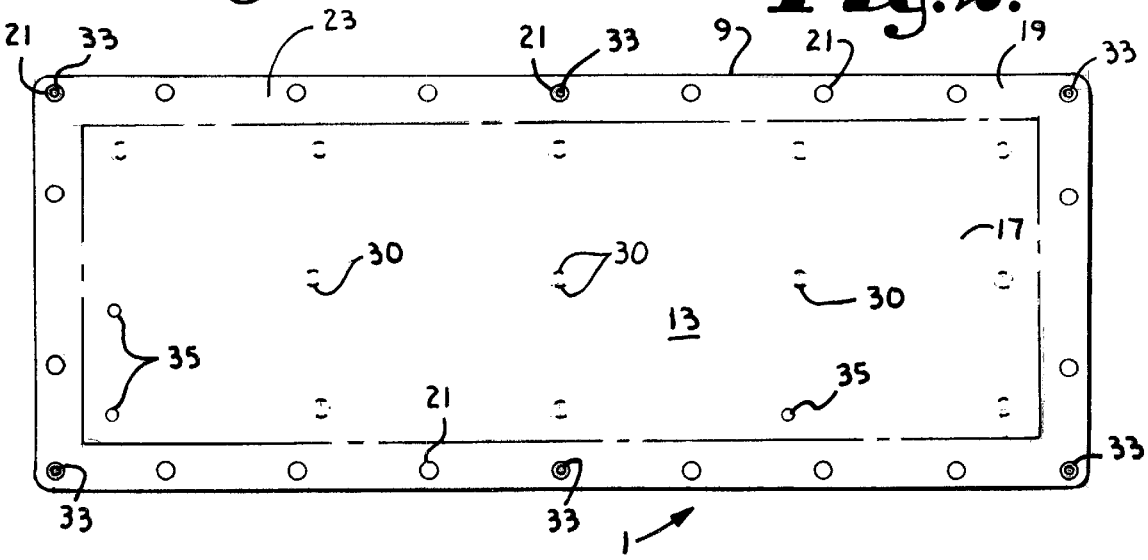
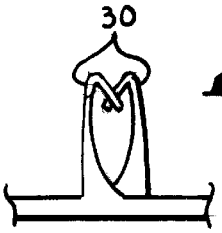
Fig.5.

Fig. 3.
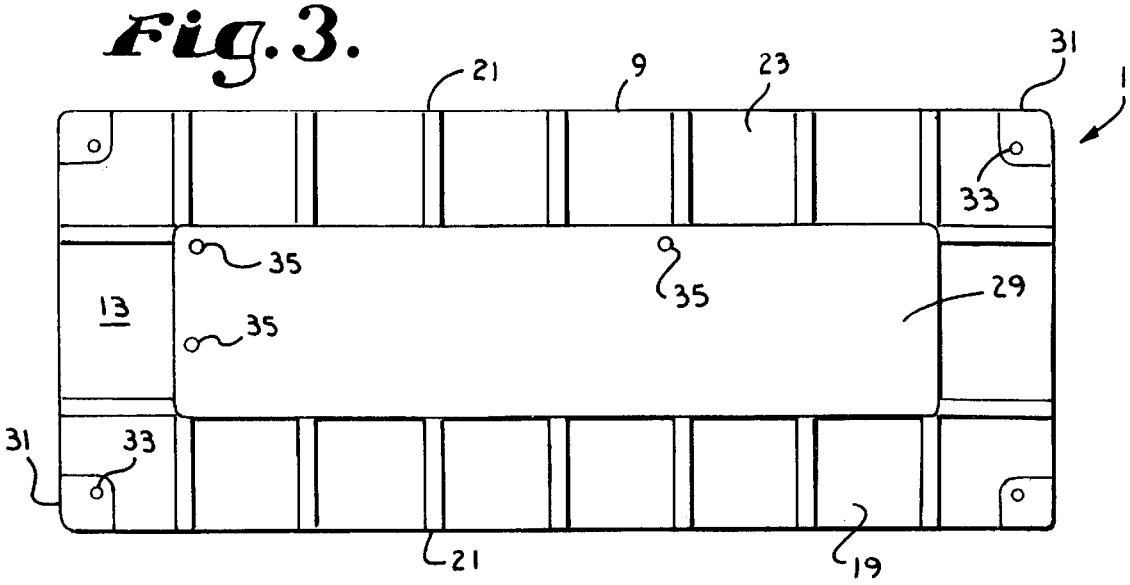
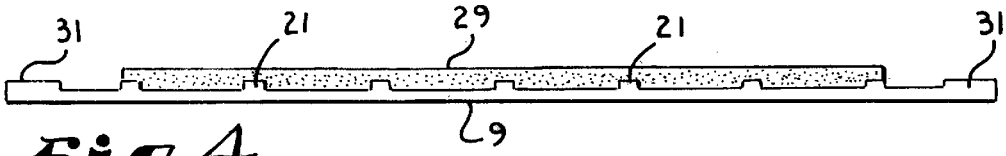
Fig. 4.
Fig. 6.
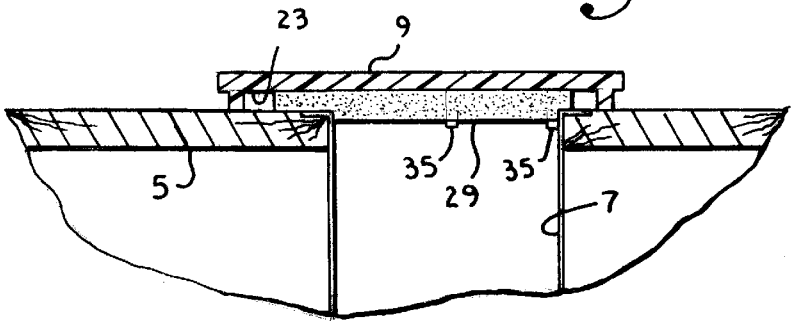

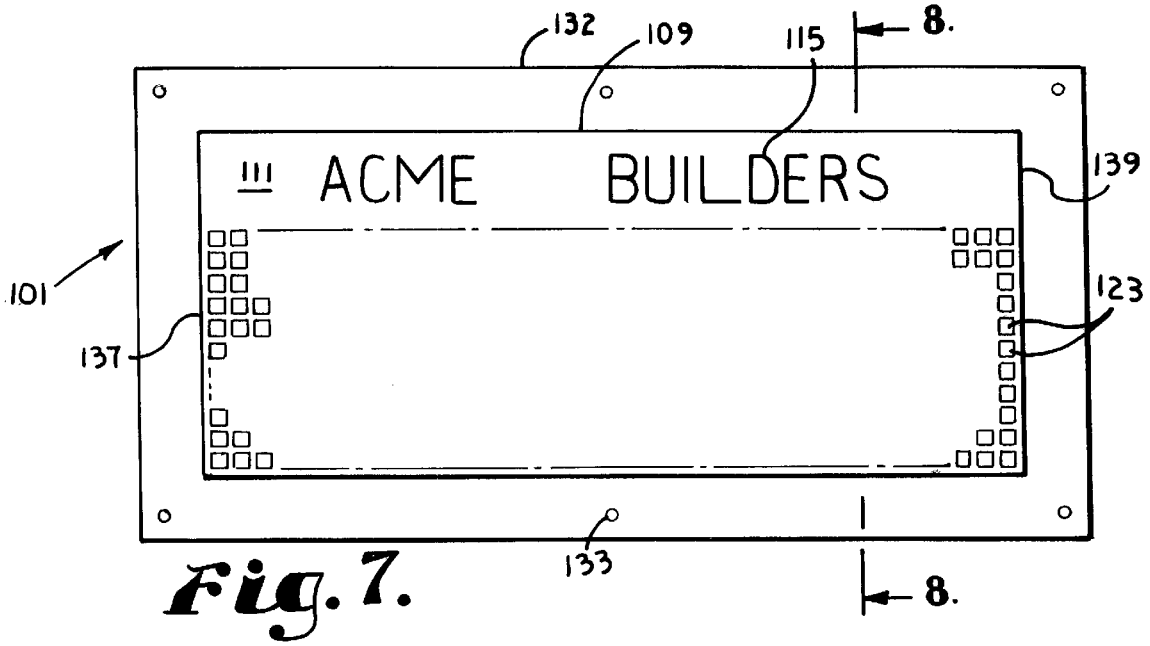
Fig. 7.
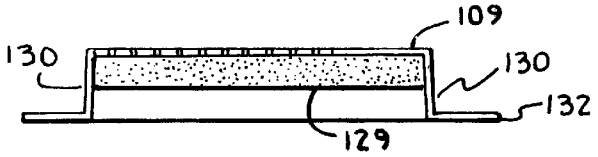
Fig. 8.
Fig. 9.
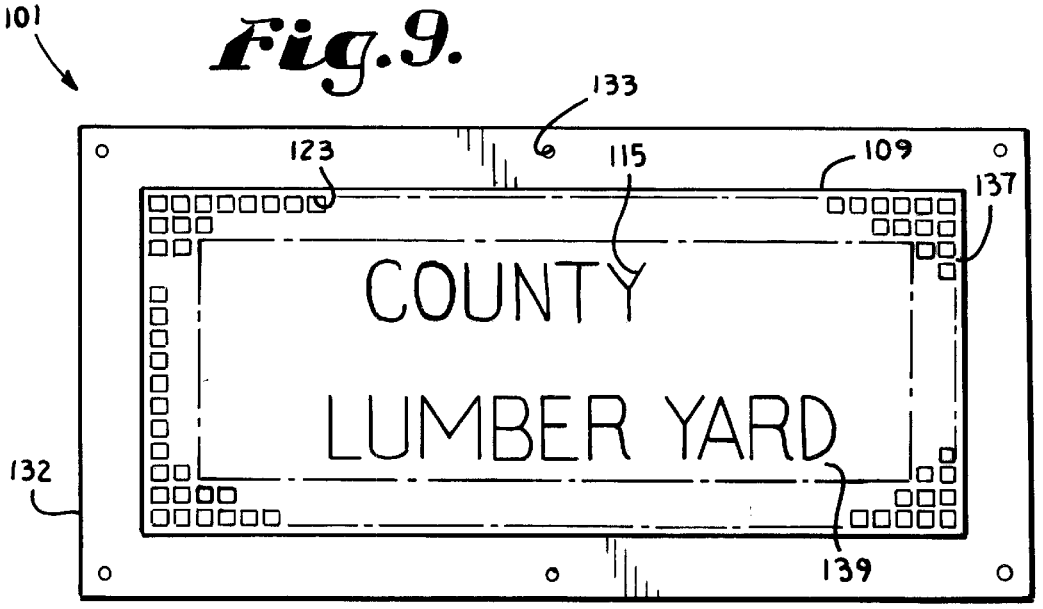

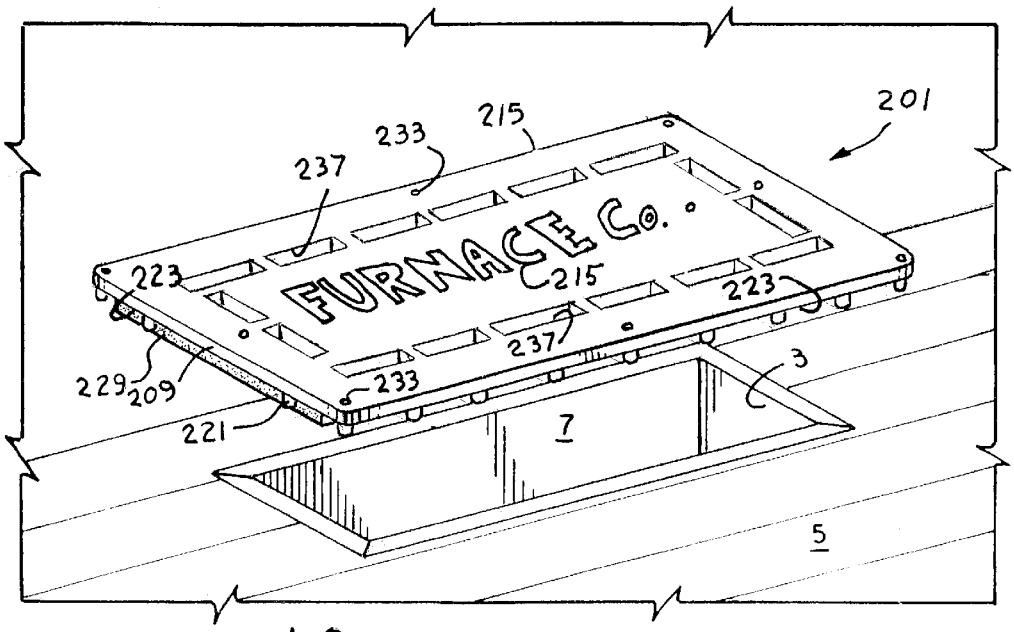
Fig. 10.
Fig. 11.
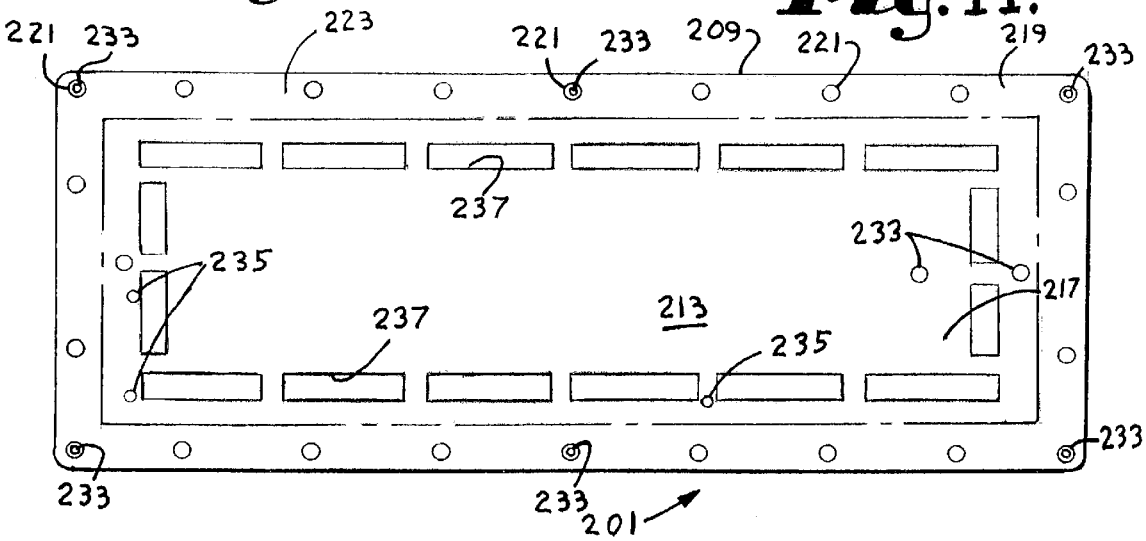

TEMPORARY VENT OPENING COVER

This application is a continuation-in-part of U.S. patent application Ser. No. 09/737,086 filed Dec. 14, 2000 U.S. Pat. No. 6,461,235 and entitled Temporary Vent Opening Cover.

BACKGROUND OF THE INVENTION

1. Field of the Invention

The invention relates generally to the field of building construction supplies, and more particularly to a cover for temporary installation over a floor vent opening to prevent construction debris from accumulating in the duct work.

2. Description of the Related Art

Homes and other buildings often include floor mounted vents which are associated with the building's heating, ventilation, and air conditioning (HVAC) systems. These floor vents may serve either as supply vents for providing fresh air to a room or as return vents for circulating air from the room back to the furnace or air conditioner. The vents are connected to the HVAC system through a system of duct work.

When a building is constructed, the vent openings and duct work are often roughed in early in the construction process and finish work continues for a substantial period of time thereafter. The grills or gratings which will eventually cover the vent openings are not generally installed until the later phases of the construction. If the vent openings are simply left open until the finish work is completed, debris from the continuing construction can fall through the openings and accumulate in the associated duct work. If the debris is not removed from the ducts it can partially block the flow of air through the duct and impair the efficiency of the HVAC system. In addition, small particles of debris such as sawdust and drywall dust can be blown out of the duct work and back into the living space, creating housekeeping problems and possibly even breathing difficulties for the building's occupants. It is therefore advantageous to prevent construction debris from entering the duct work through the floor vent openings.

Another problem presented by open floor vent openings is that they present a safety hazard to personnel working around the construction site. A worker can easily step into an unprotected opening and sustain personal injuries, such as by twisting an ankle or by tripping and falling. Occupational Safety and Health Administration (OSHA) regulations require that each employee on a walking/working surface be protected from tripping in or stepping into or through holes by covers. See 29 C.F.R. §1926.501 (b)(4)(ii). For purposes of this regulation, a "hole" is defined as a gap or void 2 inches (5.1 cm) or more in its least dimension, in a floor, roof, or other walking/working surface. See 29 C.F.R. §1926.500(b). This definition would include the majority of floor vent openings.

In order to comply with OSHA regulations, a cover must be capable of supporting, without failure, at least twice the weight of employees, equipment, and materials that may be imposed on the cover at any one time. See 29 C.F.R. §1926.502(i)(2). The cover must be secured so as to prevent its accidental displacement by the wind, equipment, or employees. See 29 C.F.R. §1926.502(i)(3). All covers shall be color coded or they shall be marked with the word "HOLE" or "COVER" to provide warning of the hazard. 29 C.F.R. §1926.502(i)(4).

Those contractors who have previously attempted to address these problems have generally done so by covering the vent openings with a solid surface, such as a piece of sheet metal or plywood. While this method is effective for preventing debris from falling into the vent openings, it also prevents the construction workers from enjoying the benefits of having the HVAC system operating while they complete their work. Having the HVAC system operating during construction not only aids in maintaining the comfort level of the workers, but is also helpful in curing drywall compound and other similar materials used in the construction. These hastily constructed covers are also often deficient because they fail to meet the requirements of the aforementioned OSHA regulations.

What is needed is a strong, temporary cover for the vent openings which prevents even small debris from entering the duct work, but which allows air to flow through the opening so that the HVAC system can be operated during construction. A previous solution to this problem is disclosed by U.S. Pat. No. 4,829,886 to George Battaglin entitled Central Heating System Vent Guard. The Battaglin device comprises a guard with a central recess or trap and a circumferential flange which surrounds the recess. The recess is designed to extend downwardly into the vent opening such that the flange is generally in contact with the floor adjacent to the opening. The flange includes a plurality of raised portions which allow air to pass between the flange and the floor. One disadvantage of this device is that its usage would still allow dust and small debris items to be inadvertently swept into the vent openings through the air passages during routine site clean-up. This problem is compounded if the cover is not securely fastened to the floor and lifts up when pushed against by a broom. A second problem is that the recess in the guard represents a safety hazard in that it provides an opening into which a person could step, causing injury. In addition, debris which collects in the recess cannot be swept out and will have to be manually removed from the recess, making clean-up more difficult.

SUMMARY OF THE INVENTION

The present invention comprises a temporary cover for use during building construction to prevent debris from entering floor vent openings. The cover has a generally flat upper surface which allows any debris which accumulates on the cover to be simply swept or vacuumed away. The cover further includes a plurality of air passages which allow the HVAC system to be operated with the covers in place so that the construction workers can work in a heated or air conditioned environment. The air passages are protected by a layer of filter material which helps prevent small debris from entering the vent opening through the air passages.

An additional function of the generally flat upper surface of the cover is that it can serve as a location for the printing of logos or other promotional indicia. This feature would allow a business such as a contractor, lumberyard, or furnace or air conditioning equipment supplier to place their company name or advertising on the vent covers where it would be seen by other persons in the building trades who might purchase their products or services. Promotional logos directed toward homeowners could also be printed on the cover to promote a business's goods and services to potential home buyers viewing the house under construction.

BRIEF DESCRIPTION OF THE DRAWINGS

FIG. 1 is an exploded perspective view showing a temporary vent opening cover embodying the present invention over a floor vent opening.

FIG. 2 is a bottom view of the vent opening cover of FIG. 1 with the filter material removed.

FIG. 3 is a bottom view of a vent opening cover similar to the vent opening cover of FIG. 1, but with legs shaped in the form of ribs.

FIG. 4 is a side view of the vent opening cover of FIG. 3.

FIG. 5 is a greatly enlarged perspective view of the filter material attaching hooks of the vent opening cover.

FIG. 6 is a cross-sectional view of the vent opening cover installed over a floor vent opening taken generally along line 6—6 in FIG. 1.

FIG. 7 is a top view of a modified embodiment of the vent opening cover showing the cover plate divided longitudinally between perforated and nonperforated portions.

FIG. 8 is a cross-sectional view of the modified embodiment of the vent opening cover taken generally along line 8—8 in FIG. 7.

FIG. 9 is a top view of the modified embodiment of the vent opening cover showing the cover plate having a central nonperforated portion and a peripheral perforated portion.

FIG. 10 is an exploded perspective view showing a third embodiment of the temporary vent opening cover of the present invention over a floor vent opening.

FIG. 11 is a bottom view of the vent opening cover of FIG. 10 with the filter material removed.

DETAILED DESCRIPTION OF THE PREFERRED EMBODIMENTS

I. Introduction

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

II. First Embodiment

Referring to the drawings in more detail, the reference number 1 generally designates a vent opening cover embodying the present invention. The cover 1 is especially designed to cover a vent opening 3 in a floor 5, to prevent debris from entering the associated duct work 7, however the cover 1 may also be used to cover similar vent openings in walls, ceilings, or other surfaces if there is danger of debris entering these openings under the particular conditions of the job site.

The cover 1 can be formed by a variety of methods from any of a wide variety of strong, durable materials, however a preferred construction technique is to form the cover 1 of injection molded ABS or other highly impact resistant plastic. The cover 1 includes a generally rectangular cover plate 9 which is sized and shaped to completely cover the vent opening 3 and overlap a portion of the floor 5. The cover plate 9 is preferably of a size that allows a single cover 1 to used to cover any of a variety of standard size vent openings 3 such as 2"×10", 4"×10" and 4"×12" openings, for example. It is foreseen, however, that the cover 1 could also be manufactured in a variety of sizes and shapes to cover vent openings 3 of widely divergent sizes.

The cover plate 9 should be at least strong enough to support the weight of any individual who might step on it, without breaking. The cover plate 9 is preferably also brightly colored so as to warn workers of a potential hazard.

The cover plate 9 has a top surface 11 and a bottom surface 13. The top surface 11 is generally flat and can provide a location for a logo or other promotional indicia 15 which can be affixed to the cover 1 in any known manner, such as by printing, engraving, embossing, or the use of adhesive stickers or decals. The promotional indicia 15 placed on the cover plate 9 may, for example, be that of the general contractor of HVAC contractor working on the site. The ability to display such promotional indicia 15 on the cover 1 helps to encourage contractors to use the covers 1 because it provides them with a marketing benefit in addition to the primary benefits of safety and cleanliness.

Other potential advertisers include material and equipment suppliers who would be placing their promotional indicia 15 in a location where it would be seen by contractors and other persons in the building trades who might purchase their products. The suppliers would most likely purchase vent opening covers 1 with their promotional indicia 15 displayed thereon and then distribute them by sale or giveaway to appropriate contractors who would then use them on the jobsite.

The bottom surface 13 of the cover plate 9 is generally divided into a central portion 17, which is somewhat larger than the largest vent opening 3 over which the cover 1 is to be used, and a peripheral portion 19 which surrounds the central portion 17. The cover plate 9 is spaced outwardly from the floor 5 by a plurality of legs or pedestals 21 which extend downwardly from the peripheral portion 19 of the bottom surface 13. The legs 21 can be of any of a variety of shapes; for example, the legs 21 are shown in FIGS. 1 and 2 as being cylindrical or tubular in shape, and in FIGS. 3 and 4 as being elongate ribs oriented transversely to the narrow dimensions of the peripheral portion 19.

In an injection molded cover 1 having rib shaped legs 21, the ribs would preferably have a thickness which is generally the same as the thickness of the cover plate 9. If the ribs 21 are substantially thicker than the plate 9, the thicker portions of the cover 1 adjacent to the ribs 21 will cool and contract at a different rate than the thinner portions and create sink marks in the top surface 11 over the ribs 21. These sink marks would detract from the appearance of the cover 1 and adversely affect the application of the promotional indicia 15.

The spaces between the legs 21 define a plurality of air channels 23 which allow air to pass between the cover plate 9 and the floor 5 so that airflow between the duct work 7 and the surrounding room or workspace may be maintained with the cover 1 in place. A pad of open-cell foam air filter material 29 having generally the same outer dimensions as the central portion 17 of the plate 9 is installed over the central portion 17, between the legs 21. The filter material 29 is also preferably sized to be somewhat wider and longer than the vent opening 3 over which the cover 1 is to be used.

The filter material 29 has a thickness which is preferably at least approximately equal to the height of the legs 21, and may even be somewhat thicker so that the edges of the pad 29 will be compressed between the floor 5 and the cover plate 9 when the cover 1 is installed over the vent opening 3, thereby creating a tight seal. If the pad 29 is less thick than the height of the legs 21, the seal will be less effective. If the discrepancy is small, however, the amount of debris which will bypass the filter 29 will be minimal. It is, therefore, to be understood that vent covers 1 with filter pads 29 which are slightly less thick than the height of the legs 21 are within the scope of the present invention.

The filter material 29 may be attached to the bottom surface 13 of the plate 9 by use of an adhesive or by any of a variety of known methods, or the central portion 17 of the plate 9 may be provided with a plurality of hooks 30 which are designed to penetrate the filter material 29 and hold it in place relative to the cover plate 9. In order to provide the surest grip on the filter material 29, the hooks 30 are preferably arranged in closely spaced pairs as shown in FIG. 5, the hooks 30 in the pair having their barbs pointing in opposite directions. The opposedly paired hooks 30 also have the function of creating localized tension in the filter material 29. This tension pushes the filter material 29 onto the barbs of the hooks 30 and helps to hold the filter material 29 in place relative to the cover plate 9.

The cover 1 is temporarily secured to the floor 5 by screws or other fasteners which are inserted through mounting holes 31 extending through the cover plate 9. The mounting holes 31 are preferably positioned proximate each of the four corners of the cover plate 9 and midway along the longer sides of the plate 9. If the cover 1 includes tubular legs 21, the mounting holes 31 may each be located over a respective one of the legs 21 so that fastener extends through the center of the leg 21. If the cover 1 has legs 21 which cannot accommodate the fasteners, such as the rib-like legs shown in FIGS. 3 and 4, then mounting bosses 33 can be added to provide locations for the mounting holes 31. The mounting bosses 31 extend downward from the bottom surface 13 of the cover plate 9 and have a height which is equal to the height of the ribs 21.

The cover 1 may also include two or more registration pegs 35 (three shown) which depend downward from the central portion 17 of the cover plate 9 at points which correspond to edges of the vent opening 3. The registration pegs 35 serve to help locate the cover 1 over the vent opening 3.

In use, the cover 1 is placed over the vent opening 3 with the registration pegs 35 each engaging edges of the floor 5 adjacent the opening 3, and secured in place with screws or other fasteners inserted through the mounting holes 33. When the cover 1 is so installed, the air channels 23 each become bounded on their bottom sides by the floor 5. The filter material 29 is compressed around its peripheral edges between the floor 5 and the cover plate 9, creating a seal between the filter material 29 and the floor 5. The channels 23 allow air to flow between the duct work 7 and the room through the opening 3, however the channels 23 are protected by the filter material 29 which restricts the entry of debris into duct work 7 through the air channels 23.

III. Second Embodiment

An alternative embodiment of the present invention, vent opening cover 101, is shown in FIGS. 7–9. The vent opening cover 101 shares many of the features of the cover 1, in that it includes a cover plate 109 having a generally flat top surface 111, portions of which may serve as a location for the printing of promotional indicia 115, and a plurality of air passages 123 which are protected by a layer of filter material 129.

The cover 101 differs from the cover 1 primarily in that the cover plate 109 is raised above the level of the floor 5 by sidewalls 130 and the air passages 123 are formed through the cover plate 109 instead of being located between the cover plate 109 and the floor 5. These modifications make it possible to clean around the cover 101 without risk of debris being swept into the air passages 123, as can sometimes occur with the passages 23 of the cover 1. While the filter material 29 of the cover 1 generally restrains such swept-in debris from entering the duct work 7, this debris can clog the air passages 23 and prevent air from passing therethrough The cover plate 109 of the vent opening cover 101 is generally sized and shaped to match the vent opening 3. The sidewalls 130 extend downward from the outer edges of the plate 109 to a peripheral mounting flange 132 and present a solid barrier which prevents the passage of debris between the floor 5 and the cover plate 109. A plurality of mounting holes 133 are formed through the flange 132 for the insertion of nails, screws, or other like fasteners for securing the cover 101 to the floor 5.

The air passages 123 of the cover 101 take the form of a plurality of openings passing through the cover plate 109. While the air passages 123 are shown in the drawings as being square holes, it is to be understood that the shape of the openings is not critical and that the air passages may be of various configurations, including holes of any shape, slots, and louvers. The air passages 123 should, however, be arranged so as to leave a relatively large, flat, nonperforated area of the cover plate 109 free for the application of promotional indicia 115. This can be accomplished, for example, by dividing the cover plate 109 lengthwise into a perforated section 137 and a nonperforated section 139, as shown in FIGS. 5 and 6. Alternatively, the nonperforated section 139 may be located in the center of the cover plate 109, with the perforated section 137 around the periphery of the plate 109 as shown in FIG. 7.

The filter material 129 is attached to the underside of the cover plate 109 by an adhesive, hooks molded into the cover plate 109, or other means known in the art so as to protect the air passages 123 and prevent debris, generally in the form of dust, from entering the duct work 7 therethrough.

IV. Third Embodiment

A third embodiment of the present invention, vent opening cover 201, is shown in FIGS. 10 and 11. The cover 201 is similar to the cover 1 described above and includes a generally rectangular cover plate 209 having a top surface 211 and a bottom surface 213. The top surface 211 is generally flat and can provide a location for a logo or other promotional indicia 215.

The bottom surface 213 of the cover plate 209 is generally divided into a central portion 217 (the boundaries of which are indicated by the dashed line in FIG. 11), which is somewhat larger than the largest vent opening 3 over which the cover 201 is to be used, and a peripheral portion 219 which surrounds the central portion 217. The cover plate 209 is spaced outwardly from the floor 5 by a plurality of legs or pedestals 221 which extend downwardly from the peripheral portion 219 of the bottom surface 213. The spaces between the legs 221 define a plurality of air channels 223 which allow air to pass between the cover plate 209 and the floor 5.

A pad of open-cell foam air filter material 229 is installed over the central portion 217 of the cover plate 209. The pad of filter material 229 is generally the same size as the central portion 217 and slightly larger in width and length than the vent opening 3 over which the cover 201 is to be used. The filter material 229 has a thickness which is preferably at least approximately equal to the height of the legs 221, and may even be somewhat thicker so that the edges of the pad 229 will be compressed between the floor 5 and the cover plate 209 when the cover 201 is installed over the vent opening 3, thereby creating a tight seal. If the pad 229 is less thick than the height of the legs 221, the seal will be less effective. It is foreseen, however, the if the pad 229 is only slightly less thick than the height of the legs 221, the amount of debris which will bypass the filter 229 will be minimal, and such vent opening covers 201 are considered to be within the scope of the present invention.

The cover 201 is temporarily secured to the floor 5 by screws or other fasteners which are inserted through mounting holes 231 extending through the cover plate 209. The cover 1 may also include two or more registration pegs 235 (three shown) which depend downward from the central portion 217 of the cover plate 209 at points which correspond to edges of the vent opening 3.

The primary difference between the vent opening cover 201 and the vent opening cover 1 is that the cover 201 further includes additional air channels 237 which pass through the cover plate 209. The openings 237 are positioned above the filter material 229 such that the filter material 229 covers the openings 237 and thereby inhibits debris from passing therethrough.

The air channels 237 are preferably oriented so as to leave a relatively large, flat, nonperforated area of the top surface 211 of the cover plate 209 free for the application of the promotional indicia 215. This can be accomplished, for example, by dividing the cover plate 209 into perforated and nonperforated portions as discussed in reference to the vent opening cover 101 above, or by arranging the openings 237 in a ring as shown in FIGS. 10 and 11.

It is to be understood that while certain forms of the present invention have been illustrated and described herein, it is not to be limited to the specific forms or arrangement of parts described and shown.

What is claimed and desired to be secured by Letters Patent is as follows:

1. A temporary vent opening cover securable over a vent opening in a surface of a room during building construction to prevent debris from entering the vent opening and accumulating in duct work associated therewith, comprising:

a) a cover plate sized and shaped to cover the vent opening, said cover plate having a central portion sized somewhat larger than said vent opening, a peripheral portion surrounding said central portion, an inner face and an outer face;

b) a plurality of legs extending outwardly from said inner face of said cover plate along said peripheral portion, said legs adapted to space said inner face outwardly from the surface a first distance when said vent opening cover is secured over the vent opening;

c) a plurality of first air passages formed between said legs; and d) a pad of air filter material sized to be somewhat larger than the vent opening, said pad having a first face, a second face, and a thickness approximately equal to or greater than said first distance, said first face of said pad being secured to said inner face of said central portion of said cover plate such that said pad extends across said first air passages and inhibits the passage of debris therethrough.

2. The temporary vent opening cover as in claim 1, wherein said cover plate outer face includes a flat and contiguous portion thereof sized to be viewable by a person standing in the room to display promotional indicia thereon.

3. The temporary vent opening cover as in claim 1, wherein said legs are generally cylindrical.

4. The temporary vent opening cover as in claim 1, wherein said legs are ribs oriented transversely to the narrow dimension of said peripheral portion.

5. The temporary vent opening cover as in claim 1, wherein said filter material is attached to said cover plate by a plurality of hooks protruding from said cover plate inner face and penetrating said filter material.

6. The temporary vent opening cover as in claim 5, wherein said hooks are arranged in pairs, the hooks in each pair being closely spaced to each other and having respective barbs pointing in opposing directions.

7. The temporary vent opening cover as in claim 1, and further including a plurality of second air passages formed through said central portion of said cover plate such that said pad of air filter material extends across said second air passages and inhibits the passage of debris therethrough.

8. The temporary vent opening cover as in claim 7, wherein said second air passages are formed through only a first part of said central portion of said cover plate so as to leave a second nonperforated part of said central portion outer face free for the display of promotional indicia.

9. The temporary vent opening cover as in claim 1 which further includes a plurality of registration pegs extending outwardly from said cover plate inner face for locating said vent opening cover relative to the vent opening.

10. The temporary vent opening cover as in claim 1 wherein said cover plate has a strength sufficient to support the weight of a person.

11. The temporary vent opening cover as in claim 1 wherein said cover plate is brightly colored to serve as a hazard warning.

12. A temporary vent opening cover securable over a vent opening in a surface of a room during building construction to prevent debris from entering the vent opening and accumulating in duct work associated therewith, comprising:

a) a cover plate sized and shaped to cover the vent opening and a portion of the surface surrounding said vent opening, said cover plate having an inner face and an outer face;

b) a plurality of legs extending outwardly from said inner face and adapted to engage the surface so as to space said inner face outwardly from the surface a first distance when said vent opening cover is secured over the vent opening;

c) a plurality of first air passages formed between said legs; and d) a pad of air filter material sized to be somewhat larger than the vent opening, said pad having a thickness approximately equal to or greater than said first distance, said pad being secured to said inner face of said cover plate such that said pad extends across said first air passages and inhibits the passage of debris therethrough.

13. The temporary vent opening cover as in claim 12, wherein said cover plate outer face includes a flat and contiguous portion thereof sized to be viewable by a person standing in the room to display promotional indicia thereon.

14. The temporary vent opening cover as in claim 12, and further including a plurality of second air passages formed through said central portion of said cover plate such that said pad of air filter material extends across said second air passages and inhibits the passage of debris therethrough.

15. The temporary vent opening cover as in claim 14, wherein said second air passages are formed through only a first part of said cover plate so as to leave a second nonperforated part of said outer face free for the display of promotional indicia.

16. The temporary vent opening cover as in claim 14 wherein said cover plate has a strength sufficient to support the weight of a person.

17. The temporary vent opening cover as in claim 12 which further includes a plurality of registration pegs extending outwardly from said cover plate inner face for locating said vent opening cover relative to the vent opening.

* * * * *